US005267321A

United States Patent [19]

Langberg

[11] Patent Number: 5,267,321

[45] Date of Patent: Nov. 30, 1993

[54] ACTIVE SOUND ABSORBER

[76] Inventor: Edwin Langberg, 56 Bridge Rd., Medford, N.J. 08055

[21] Appl. No.: 794,449

[22] Filed: Nov. 19, 1991

[51] Int. Cl.[5] ..... H04R 25/00

[52] U.S. Cl. ..... 381/72; 381/71; 381/68.6

[58] Field of Search ..... 381/72, 68.6, 163, 96, 381/71

[56] References Cited

U.S. PATENT DOCUMENTS

| | | | |
|---|---|---|---|
| 4,149,612 | 4/1979 | Bachorr | 181/286 |
| 4,325,458 | 4/1982 | Bachorr | 181/227 |
| 4,325,461 | 4/1982 | Bachorr | 181/286 |
| 4,609,784 | 9/1986 | Miller | 381/96 |
| 4,985,925 | 1/1991 | Langberg et al. | 381/71 |
| 5,031,221 | 7/1991 | Yokoyama | 381/96 |

FOREIGN PATENT DOCUMENTS

| | | | |
|---|---|---|---|
| 8912432 | 12/1989 | World Int. Prop. O. | 381/72 |

*Primary Examiner*—Jin F. Ng
*Assistant Examiner*—Huyen D. Le

[57] ABSTRACT

The Active Sound Absorber of the invention is based on an electroacoustical transceiver defined as a bilateral electroacoustical transducer acting as both a diaphragm actuator and motion sensor, and an associated mutual inductance discriminator, in a electroacoustical positive feedback system. Selected embodiment of such a system is an unvented hearing aid where the Active Sound Absorber combats the occlusion effect.

11 Claims, 1 Drawing Sheet

ACTIVE SOUND ABSORBER

BACKGROUND OF THE INVENTION

1. Field of the Invention

The field of the invention is electrical audio-signal processing, systems, and devices. The Active Sound Absorber of the invention is based on an electroacoustical transceiver, defined as a bilateral electro-acoustical transducer acting as both a diaphragm actuator and motion sensor, and an associated mutual inductance discriminator in a electroacoustical feedback system. The selected embodiment of such a system is an unvented hearing aid where the Active Sound Absorber combats the occlusion effect.

2. Description of the Related Art

Sound absorbers based on acoustical resonance have been used since they were originally proposed by Helmholtz about a century ego. Sound absorbers are used in a variety of products from perforated ceiling tiles to the so called "silators" proposed by Oskar Bschorr in U.S. Pat. Nos. 4,149,612, 4,325,458 and 4,325,461. Passive resonant sound absorbers of the art are effective only in a limited-frequency range close to the resonance frequency of the device. At resonance, the mass and compliance components of a series acoustical resonance network of the absorber cancel, and the absorber acts as a low-impedance acoustical resistor, absorbing the impinging sound. Low-frequency absorbers are inconveniently large.

Addition of an external sensor and actuator to drive a passive silator was proposed by Bschorr in a technical paper: "An Integrated Microphone/Loudspeaker Unit for Active Noise Cancellation" given at Inter-Noise meeting in Cambridge, Mass., Jul. 21-23, 1986. (The Proceedings of this meeting have been edited by R. Lotz and published by the Noise Control Foundation). Such a three element active-sound absorber design is complex and bulky. Further external components each add delay and phase shift which complicates the feedback loop stabilization and limits the useful frequency range of such an active absorber. The design of the appropriate feedback circuit was not addressed in the paper.

When the entrance to the ear canal is occluded, e.g., by wearing an unvented hearing aid, the low-frequency component of the wearer's own voice produces a sound in the ear which is markedly different from the sound in an open ear. This so called "occlusion effect" is caused by the bone conducted low-frequency portion of the wearer's own voice which is not vented to the outside in the occluded ear canal. The uncompensated occlusion effect in a sealed ear canal manifests itself as an objectionable feeling of "echoing" in the ear and is the key reason why venting is customarily provided in hearing aids in spite of significant advantages of unvented devices.

The chief negative consequence of venting of hearing aids is that venting limits the amount of gain available before the onset of positive feedback oscillation between an outside microphone and an inside speaker. In addition, venting may reduce a desired low-frequency gain, add a vent-associated resonance, and allow background noise outside the pass band of the hearing aid to enter the ear canal and be combined with the amplified signal.

Venting may be altogether impractical for certain types of hearing aids. For instance, space limitations often preclude the use of venting with in-the-ear canal hearing aids (the most rapidly increasing style of hearing aids). As a result, one of the significant limitations sometimes created by these hearing aids is the increased sensitivity to the occlusion effect. The present invention provides an alternative to venting, whereby a significant improvement in hearing aid performance can be realized.

The Active Sound Absorber of this invention does not belong to the specie of Active Noise Reduction systems, yet a comparison may be in order. Active Noise Reduction is based on the generation of a counter-noise, i.e., a waveform precisely equal to and of opposite polarity to the noise waveform, as compared to broad band absorption provided by the Active Sound Absorber. Active Noise Reduction, e.g., as described in FIG. 2 of the U.S. Pat. No. 4,985,925 by Langberg et al is based on electroacoustical negative feedback, whereas the Active Sound Absorber typically uses positive feedback. (Please note that Langberg is also the inventor of the present invention; here Langberg et al refers to the U.S. Pat. No. 4,985,925).

The design in Langberg et al comprises a summing microphone located inside of the ear canal to provide an acoustical feedback signal, whereas in this invention no such microphone is required. Modern hearing aids are often of the in-the-ear-canal type where space is at a substantial premium and adding a summing microphone, required in an Active Noise Reduction system, to the already crowded assembly, is difficult. Further the separation of the speaker and summing microphone in an Active Noise Reduction system introduces acoustical phase shift and delay which limits performance and requires compensation to maintain stability thus complicating the design.

SUMMARY OF THE INVENTION

A primary object of the present invention is an electroacoustical transceiver employing a single bilateral transducer operating simultaneously as a speaker and a microphone and producing, in conjunction with a discriminator circuit, an output signal representing accurately the diaphragm velocity. The preferred embodiment of the transducer is of an electromagnetic (reluctance) variety resulting in high sound output from even a small device.

Another object of the present invention is the use of the above transceiver in an electroacoustical feedback network configured to cause the transducer to act as an active acoustical absorber. The preferred embodiment of this configuration is in an occluded hearing aid where the transceiver acts as a speaker and as an absorber. The Active Sound Absorber combats the occlusion effect which would otherwise be present.

The hearing aid assembly of the preferred embodiment is acoustically sealed against the ear canal wall. This seal attenuates the direct penetration of ambient sound into the ear canal. The seal also passively reduces the escape of sound generated by the hearing aid speaker from reaching the outside microphone. This feature allows more hearing aid amplification before the onset of the undesirable oscillation caused by positive feedback.

Application of the Active Sound Absorbers in unvented hearing aids is to combat the occlusion effect. The reduction in the occlusion effect brought about by the Active Sound Absorbers of the present invention works by substitution of low sound-absorber impedance for the low impedance of the open ear.

It is further an object of the present invention to apply the Active Sound Absorber system in communication and entertainment headsets. Other objects and features of the invention will become more apparent from the following detailed description, taken in connection with the accompanying drawings, wherein:

DESCRIPTION OF THE PREFERRED EMBODIMENTS

There is a potential for misunderstanding regarding the conflicting use of terminology in audiology and in electrical engineering. The term "feedback" as used here, is defined generically as a return of a fraction of an output signal to a input signal. Specifically, the feedback in the electroacoustical feedback loop performs the desirable Active Sound Absorber function. In audiology, the term "feedback" is used more narrowly as synonymous with the undesirable positive feedback between the outside hearing aid microphone and the internal speaker which causes an oscillation in the form of an annoying whistle. Audiologists often refer to the earphone in the hearing aid as a "receiver" but the less ambiguous terms "speaker" or "transducer", will be use here, as appropriate.

An electro-acoustical transducer typically is used either as a speaker or as a microphone, depending on the connection. For example, an electromagnetic (reluctance) or an electrodynamic transducer with diaphragm motion energized by current through the transducer winding acts as a speaker. The same transducer will produce, in response to diaphragm movement, an output voltage across the winding, and when connected across a preamplifier will act as a microphone. A bilateral transducer, as defined here, is an electroacoustical transducer with interconnections which allow it to be used simultaneously as both a speaker and a microphone.

The desired output from a bilateral transducer is a signal which depends only on the diaphragm velocity. The main problem with the use of bilateral transducers is the undesired coupling between the speaker drive and the microphone output. The problem of decoupling in electromagnetic transducers is complex and has not been reported. Decoupling is simpler in electrodynamic speakers and a number of designs have been proposed to accomplish electrodynamic speaker decoupling directed at providing a motional signal, used in a negative electroacoustical feedback configuration designed to improve loudspeaker performance. Examples of this art are U.S. Pat. No. 5,031,221 by Yokohama et al and U.S. Pat. No. 4,609,784 by Miller. The present art does not account for dependence of undesirable coupling on mutual inductance.

Figure 1:
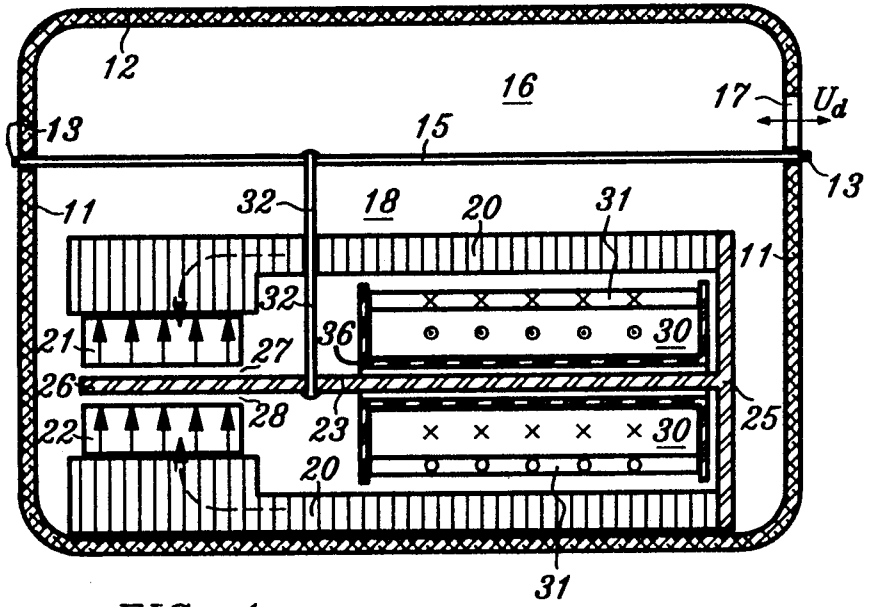
FIG. 1 is a cross-sectional view of an electromagnetic bilateral transducer.

FIG. 1 shows a cross-sectional view of the bilateral electro-acoustical transducer 10 of electro-magnetic type well suited for in-the-ear application requiring small size and high output per unit volume. Housing 11 supports a cover 12 and edges 13 of diaphragm 15. Diaphragm 15 is made of a composite of metal foil and plastic. A volume of air bounded by the diaphragm 15 and cover 12 defines a coupling chamber 16. Sound from the coupling chamber 16 flows through an opening 17, as indicated by volume velocity $U_d$, to an acoustical load, e.g., an ear canal. The fully enclosed volume of air bounded by the diaphragm 15 and the interior of housing 11 defines a reference chamber 18.

The motion generating portion of transducer 10 comprises a core 20 made of magnetically soft laminations. Permanent magnet blocks 21 and 22 are attached to the core 20. The direction of magnetization of magnets 21 and 22 is shown by arrows: it can be seen that magnets 21 and 22 are magnetized in the same direction. A thin cantilevered reed 23 is supported at one end 25 by core 20 and other end 26 is free to vibrate in air gaps 27 and 28. Reed 23 is made from magnetically soft material.

Figure 2:
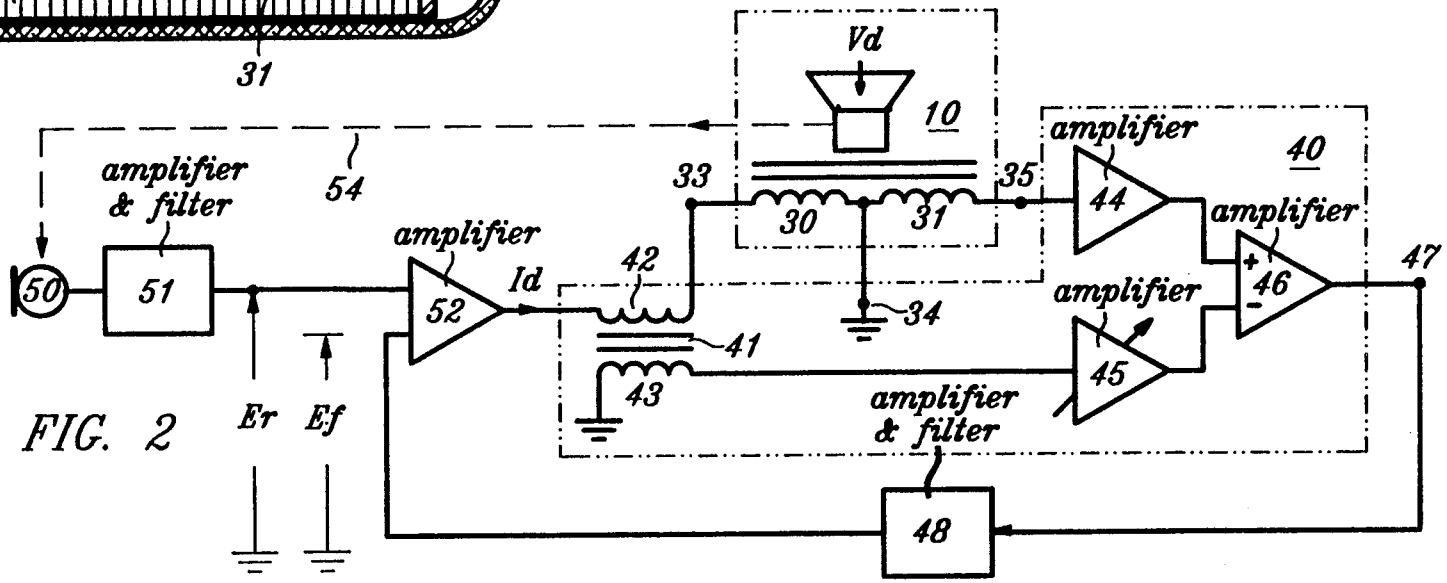
FIG. 2 is a block diagram of an Active Sound Absorber system based on an acoustical transceiver.

Two coaxial windings are wound on a bobbin 36: a driving winding 30 and a sensing winding 31. Connection of windings 30 and 31 to the outside is accomplished through terminals 33 and 35 respectively and through terminal 34 shared by the two windings, as shown in FIG. 2. Bobbin 36 is supported by the core 20. An axial opening in the bobbin 36 allows threading of the bobbin by the reed 23 without any mechanical contact or hindrance to vibration. Winding 30 is the driver coil and xxxxx and ooooo in FIG. 1 identify an instantaneous direction of ac driver current $I_d$. This driver current causes a corresponding ac magnetic flux through the cantilevered reed 23, core 20, magnets 21 and 22 and the air gaps 27 and 28. The direction of the ac magnetic flux caused by the instantaneous driver current is shown by the curved paths above the magnet 21 and below the magnet 22 in FIG. 1. Driver current, in the direction shown in winding 30, strengthens the flux in gap 28 and weakens the flux in air gap 27. As a result, a downward force is exerted on the free end 26 of reed 23 causing reed end 26 to move toward magnet 22. The motion of the reed is transmitted through a pin 32 to the diaphragm 15 causing a rarefaction of air in the coupling chamber 16 and compression of air in the reference chamber 18, and the corresponding volume velocity $U_d$ through opening 17 to the acoustical load.

As the reed 23 moves from the center position, the thickness of the air gap 28 decreases and the thickness of the air gap 27 increases. As a result, a portion of the flux created by magnet 22 now travels through the reed 23 and through the bottom portion of core 20. Voltage $V_s$ induced across the sensing winding 31 is proportional to the time rate of change of the magnetic flux through the reed 23. The flux in the reed 23 is caused both by the driver current $I_d$ and by motion of the reed, and so voltage $V_s$ across the sensing winding 31, at terminal 35, is a phasor sum of the two components:

$$V_s = M1(dI_d/dt) + KV_d \quad (1)$$

where

M1 is the mutual inductance between windings 30 and 31;

K is the electro-mechanical gyrator coefficient of the transducer; and $V_d$ is the velocity of the reed and the diaphragm.

To be useful for electroacoustical feedback, the motional component $KV_d$ is separated from driver current-induced component of $V_s$ in a discriminator circuit 40, shown in FIG. 2. Transformer 41 comprises a primary winding 42 and a secondary winding 43. Mutual inductance M2 between windings 42 and 43 is substantially equal to mutual inductance Ml between the driver winding 30 and sensing winding 31 of transducer 10. Amplifiers 44 and 45 have high input impedance and so respond to input voltage without drawing any significant current. Gain of amplifier 44 is fixed and gain of amplifier 45, while comparable to amplifier 35, can be trimmed.

The same driver current $I_d$ flows through windings 42 and 30. Now since mutual inductance M1 and M2 are comparable, the driver current-induced voltage across winding 31 and across winding 43 are nearly equal. Whatever difference exits, it is trimmed out by adjusting the gain of amplifier 45. As a result, two current-induced components at the input to an instrumentation amplifier 46 are equal and cancel at a terminal 47 corresponding to an output of amplifier 46. A signal at terminal 47 represents therefore only the desired motional signal, proportional to the velocity of the transducer diaphragm 15.

The electroacoustical feedback loop begins with a frequency-shaping network 48 accepting as input the discriminator output at terminal 47. Network 48 determines a feedback transimpedance $\beta$ which relates a diaphragm velocity $V_d$ to feedback voltage $E_f$. Amplifier 52 acts as a signal combiner: A feedback signal from 48 enters at a bottom input of amplifier 52 and a reference input signal $E_r$ enters at a top input. Amplifier 52 determines a transgain $\mu$ which relates the sum of voltages $E_r+E_f$ at the input of amplifier 53 to the driving current $I_d$, flowing through the primary discriminator winding 42 and transducer driver winding 30, thereby closing the electroacoustical feedback loop.

The remainder of the block diagram in FIG. 2 illustrates the operation of the Active Sound Absorber in hearing aid application. A hearing aid sound signal is picked up by an external microphone 50. Amplification and frequency-response shaping, dictated by the hearing disorder, is accomplished in box 51. The electrical input signal $E_r$, in supplied by the output of 51.

Figure 3:
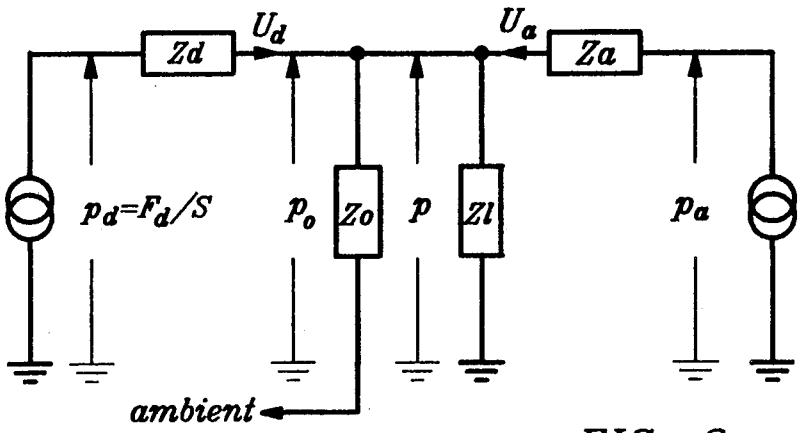
FIG. 3 shows an acoustical circuit diagram of an Active Sound Absorber system operating in an occluded ear canal.

The acoustical operation of the Active Sound Absorber in the occluded hearing aid in the ear canal is represented in FIG. 3. An occluded ear canal impedance $Z_1$, is the load impedance to the bilateral transducer, represented in turn by pressure $p_d$, produced by a driving force $F_d$ on the diaphragm, divided by the diaphragm area S, and impedance $Z_d$ of the diaphragm . $U_d$ is the volume velocity created by the diaphragm.

The jaw bone is hinged exactly at the ear canal and a small part of the ear canal wall adjoins the jaw bone. The jaw bone therefore provides a good voice-to-ear sound transmission path, represented by impedance $Z_a$ for a vocal sound $p_a$. To a lesser extent, the nasal passages and the scull also contribute to the internal voice-to-ear sound transmission impedance $Z_a$. The vocal cord generates a sound pressure $p_a$ which is transmitted via $z_a$ to the ear canal. $U_a$ is the volume velocity associated with this transmission of the occluded voice to the ear canal.

$Z_o$ represents impedance of the entrance to the ear canal to ambient air. In the open ear, $Z_o$ is much smaller than $Z_l$, and so voice sounds generated by $p_a$ tend to escape into ambient air without much effect on the ear canal pressure p. When the ear is occluded, that is when the transducer and the supporting earmold close the ear canal, the sound escape path to ambient air is closed. This is represented by an increase in occlusion impedance $z_o$: in an occluded ear $Z_a << Z_1$. Occlusion therefore creates an increased sound pressure in the ear canal due to the wearer's own voice. As shown by Westermann (Westermann, Soren: "The occlusion effect," *Hearing Instruments* 38,6:43, 1987) this increase can be more than 20 dB at frequencies below 500 Hz. Subjectively an unpleasant feeling of an "echo chamber" and fullness is typical of the occlusion effect.

Currently the addition of venting, by decreasing $Z_o$, removes the feeling of fullness caused by occlusion. However, venting opens up a path to ambient air, and generates a potential for oscillation caused by positive hearing aid feedback path 54 in FIG. 2, between the sound output of transducer 10, external microphone 50, then through amplifier 52, back to the diaphragm of the transducer 10. The size of venting in the design of a hearing aid is therefore a delicate compromise. A 2 mm diameter vent is typically needed to restore natural perception of a wearer's own voice.

Since venting increases the tendency to positive feedback oscillation, venting reduces the maximum available gain. A number of techniques have been proposed to reduce the oscillation caused by positive feedback when a portion of the speaker sound reaches the external microphone via the vent. For various reasons, discussed in some detail by Preves (Preves, D. A., Sigelman, J. A., and LeMay, P. R.: "A feedback stabilizing circuit for hearing aids" *Hearing Instruments* 37(4): 37), none of the above techniques have achieved general acceptance in hearing aid design.

Venting not only has serious shortcomings, like positive feedback instability and a drop in low-frequency response, but it is not always practical. For example, smaller hearing aids which are located in the ear canal sometimes have to be made without venting. A recent study indicated that 55% of wearers of in-the-canal hearing aids experienced problems with the feeling of fullness attributable to occlusion. In spite of these problems, there has recently been a large increase in the demand for in-the-canal hearing aids.

The Active Sound Absorber circuit in effect lowers impedance $Z_d$ and so substitutes for the low impedance $Z_o$ of an unoccluded ear. The requirement for optimal active absorption is that loop transimpedance $\mu\beta$ equals to the diaphragm impedance $Z_d$. Since a typical diaphragm impedance is a series connection of mass, compliance, and acoustical loss, the frequency-shaping network circuit 48 is typically implemented by a second order band pass filter which matches the frequency response of the diaphragm. Unlike passive absorbers which only work over a narrow frequency range near resonance, the Active Sound Absorber works over the entire frequency spectrum w over which the equation $$\mu\beta(w)=Z_d(w) \quad (2)$$

is satisfied. The microphone signal transmission into the ear is not adversely effected by the Active Sound Absorber operation.

The reduction of the occlusion effect also has application in communication headsets. A sealed speaker with an Active Sound Absorber also reduces the effect of external noise, while providing the subjective feeling of an open headset. In occluded entertainment headsets with an Active Sound Absorber, a significant feature is an efficient low-frequency response.

While the invention has been described with particular references to specific embodiments in the interest of complete definiteness, it will be understood that it may be embodied in a variety of forms diverse from those specifically shown and described, without departing from the spirit and scope of the invention.

What is claimed is:

1. An acoustical transceiver system comprising:

a bilateral transducer having a diaphragm, a driving winding, and a sensing winding, wherein a transducer input signal is a driving current flowing through the driving winding and a transducer output signal is a voltage across the sensing winding produced by motion of the diaphragm and by a transducer mutual inductance between the driving winding and the sensing winding;

a discriminator circuit comprising a transformer having a primary winding and a secondary winding, with a discriminator mutual inductance between the primary winding and the secondary winding being substantially equal to the transducer mutual inductance, and with the driving current flowing through the primary winding; and means for subtracting a voltage induced by the discriminator mutual inductance across the secondary winding of the transformer from the transducer output signal to produce a discriminator output signal, free from mutual inductance effects and proportional substantially to diaphragm velocity.

2. An acoustical transceiver system in accordance with claim 1 further comprising feedback means for generating the transducer input signal from the discriminator output signal.

3. An acoustical transceiver system in accordance with claim 2 wherein the feedback means comprises a feedback loop with transimpedance matched over a frequency spectrum to a mechanical impedance of said diaphragm for efficient operation as an active sound absorber over the frequency spectrum.

4. An improved in-the-ear active sound absorber system of a type in which a bilateral transducer generates a force on a diaphragm in response to an actuating signal and produces a transducer output signal containing at least a motional component corresponding to motion of the diaphragm; in which further the bilateral transducer is supported in the ear, the motion of the diaphragm is acoustically coupled to generate sound in an ear canal, and a processed transducer output signal, acting as a feedback signal, is combined with a reference signal to close a feedback loop by generating the actuating signal, wherein the improvement comprises:

a discriminator circuit means for input and preferential selection of said motional bilateral transducer output signal component and reduction of other components; and means for frequency-response shaping and amplification of an output signal of the discriminator for forming the feedback signal.

5. An improved in-the-ear active sound absorber system in accordance with claim 4 wherein the bilateral transducer further comprises a driving winding and a sensing winding, wherein the actuating signal is a driving current flowing through the driving winding and the transducer output signal is a voltage across the sensing winding.

6. An improved in-the-ear active sound absorber system in accordance with claim 5 wherein the discriminator circuit means comprises:

a transformer having a primary winding and a secondary winding, a discriminator mutual inductance between the primary winding and the secondary winding being substantially equal to a transducer mutual inductance between the driving winding and the sensing winding, and the driving current passing through the primary winding; and means for subtracting an induced voltage across the secondary winding from the transducer output signal to produce a discriminator output signal.

7. An improved in-the-ear active sound absorber system in accordance with claim 4 wherein the reference signal is derived from an amplified and frequency-shaped hearing aid microphone signal.

8. An improved in-the-ear active sound absorber system in accordance with claim 4 wherein the reference signal is derived from a pre-amplified and pre-emphasized communication set signal and used as a communication set.

9. An improved in-the-ear active sound absorber system in accordance with claim 4 wherein the reference signal is derived from a pre-amplified and pre-emphasized entertainment set signal and used as an entertainment set.

10. An in-the-ear active sound absorber system in accordance with claim 4 comprising means for supporting the bilateral transducer in the ear filling a space between a wall of the ear canal and an outside of the transducer, thereby acoustically attenuating sound transmission from ambient environment to an occluded ear canal.

11. An improved in-the-ear active sound absorber system in accordance with claim 4 comprising means for acoustical coupling of the motion of the diaphragm to generate sound in the ear canal having an opening and minimum separation between the diaphragm and an ear drum, for a resulting close acoustical coupling to maintain similarity between sound at the ear drum and the motion of the diaphragm.

* * * * *